US007275909B2

(12) United States Patent
Vigholm et al.

(10) Patent No.: US 7,275,909 B2
(45) Date of Patent: Oct. 2, 2007

(54) WORKING MACHINE COMPRISING AN IMPLEMENT COUPLING AND AN IMPLEMENT LOCKING ELEMENT

(75) Inventors: Bo Vigholm, Stora Sundby (SE); Joakim Sjogren, Koping (SE)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 0 days.

(21) Appl. No.: 11/163,245

(22) Filed: Oct. 11, 2005

(65) Prior Publication Data

US 2006/0104789 A1 May 18, 2006

Related U.S. Application Data

(63) Continuation of application No. PCT/SE2004/000483, filed on Mar. 30, 2004.

(30) Foreign Application Priority Data

Apr. 16, 2003 (SE) ..... 0301122

(51) Int. Cl.
*E02F 3/28* (2006.01)

(52) U.S. Cl. ..... 414/723; 37/468; 403/27

(58) Field of Classification Search ..... 414/723; 37/468; 403/27, 150, 325
See application file for complete search history.

(56) References Cited

U.S. PATENT DOCUMENTS 5,024,010 A * 6/1991 Hulden ..... 37/417
5,333,400 A 8/1994 Sonerud
5,692,855 A * 12/1997 Burton ..... 403/325
6,241,455 B1 6/2001 Schupback et al.
6,301,811 B1 10/2001 Gilmore

FOREIGN PATENT DOCUMENTS

| | | | |
|---|---|---|---|
| GB | 2259293 | | 3/1993 |
| WO | WO 0049233 | | 8/2000 |
| WO | WO 02/20906 | * | 3/2002 |

OTHER PUBLICATIONS

International Search Report and International Preliminary Examination Report for corresponding PCT/SE2004/000483.

* cited by examiner

*Primary Examiner*—Donald Underwood
(74) *Attorney, Agent, or Firm*—WRB-IP LLP

(57) ABSTRACT

A working machine includes a lift arm and an implement coupling fixed to the lift arm. The implement coupling includes a locking element which is displaceable between an inoperative position and an operative position in which it is designed to shoot into a hole in the implement in order to lock the implement to the implement coupling. The locking element, over a first section of its length, has a first cross-section that will allow the first section of the locking element to be shot into the hole in the implement, and over a second section, which adjoins the first section, has a second cross-section which prevents the second section being shot further into said hole. The second section comprises a stop face designed to be brought to bear against the implement when securing the implement to the implement coupling.

15 Claims, 6 Drawing Sheets

WORKING MACHINE COMPRISING AN IMPLEMENT COUPLING AND AN IMPLEMENT LOCKING ELEMENT

The present invention is a continuation of PCT/SE2004/000483, filed Mar. 30, 2004, which claims priority to SE 0301122-8, filed Apr. 16, 2003, both of which are hereby incorporated by reference.

BACKGROUND AND SUMMARY

The present invention relates to a working machine, comprising a lift arm and an implement coupling, which is fixed to the lift arm and comprises a locking element, which is displaceable between an inoperative position and an operative position in which it is designed to shoot into a hole in an implement in order to lock this to the implement coupling.

The invention also relates to an implement locking element, which over a first section of its length has a first cross-sectional geometry that will allow this section of the locking element to shoot into a hole of given geometry defined by an implement.

The term working machine must be regarded as signifying and may include both mobile and stationary machines. A typical example of such a machine is a wheeled loader, on which it is desirable to have the facility for coupling and uncoupling an implement or switching between various implements.

The implement may be any form of implement. It is typically an implement for cultivating soil or for construction work, or for transporting material, such as an excavator shovel, a bulldozer shovel, a pallet fork or the like.

The term lift arm relates to arms which in some way permit raising or inclining of the implement coupling arranged at their ends, for locking an implement thereto.

As used in this context, therefore, the term lift arm encompasses not only arms, the primary function of which is to lift objects, but also other arms such as an arm, the primary function of which is to couple a plough or the like.

Arranging an implement coupling, on which different implements, such as an excavator shovel, a bulldozer shovel, a fork or the like, can be locked and released, that is to say detachably fitted on the lifting arm or arms of working machines such as wheeled loaders, primarily smaller-sized ones, is already known.

The implement is conventionally provided with two hooks situated horizontally in line with one another, and two horizontal lugs or rings, which each have holes situated horizontally in line with one another. The hooks are arranged vertically above and at a distance from the holes. The implement coupling comprises corresponding coupling members in the form of two fixed pins, on to which said hooks are hitched, and two displaceable pins situated in line, which by a horizontal translational movement are shot into the holes once the hooks have been hitched on to the fixed pins. The displaceable pins are preferably hydraulically powered.

Locking of the implement is usually done by an operator, who from an operating station, such as a driver's cab on the machine, guides the lift arm to a position in which the fixed pins of the implement coupling are made to engage with the hooks of the implement. The operator is normally able to verify visually that the hooks are engaged with the pins. Following this, or at the same time, the lift arm is guided so that said holes are situated in the position in which the displaceable pins can be shot through them, following which these pins, guided by controls located in the operating station, are hydraulically shot into the holes, thereby locking the implement to the implement coupling.

One problem on many working machines is that it is difficult for the operator, from the operating station, to visually verify whether the displaceable pins are actually engaged in the implement holes. It can happen that one or both of the pins misses the hole and merely bears against the material of the implement surrounding the hole and is therefore not displaced right into its operative engagement position. According to the prior art the pin has therefore been mechanically linked to a physical flag, which has shown whether or not the pin has been displaced into its operative position, that is to say far enough. A disadvantage with this known system, however, is that it can be unreliable in cases where dirt and other material occurring on the implement during operation prevent the flag from functioning or destroy it outright. Furthermore, such a flag will incorrectly indicate that coupling has occurred should the pin in question pass right beside the implement, that is to say when either the hole or the lug etc. in which the hole is situated, is struck by the pin. The pin will thereby be displaced right to the position which by definition is its operative position without any engagement with the implement hole occurring, the flag at the same time nevertheless falsely indicating that coupling has been effected.

It is desirable to provide a working machine with a construction which solves the aforementioned problems or at least facilitates a solution to these problems. The working machine should be designed so that it makes it possible to reliably determine that a displaceable locking element, corresponding to any of the above-mentioned displaceable pins, really is in effective engagement with an implement and shoots into holes arranged therein.

In so doing, the working machine should be designed so that it can be reliably determined that the locking element really has been displaced into the hole in question.

According to an aspect of the present invention, a working machine comprises a locking element having, over a first section of its length, a first cross-section which allows the first section of the locking element to be shot into a hole on an implement, and having over a second section, which adjoins the first section, a second cross-section which prevents the second section being shot further into said hole, the second section comprising a stop face designed to be brought to bear against the implement when securing the implement to the implement coupling. In other words, the second section projects radially from the first section to such an extent that once the first section has been introduced into the hole further displacement of the second section into a hole of given cross-section is prevented by the bearing face bearing against the implement material surrounding the hole. The term cross-section does not necessarily relate simply to shape, but may alternatively relate to size. The invention includes embodiments in which the first section and the second section have different or identical cross-sectional shapes, and different or identical sizes. A radially projecting stop face or bearing face is formed at the transition between said sections.

A prerequisite is thereby created allowing it to be determined whether the locking element has actually been fully displaced so that it engages in the hole in question. When the stop face encounters the implement, this can be suitably registered, for example by means of electrical sensors, as will be described later, and a signal indicating this relayed to an operator and displayed, for example, on an instrument panel in a driver's cab or the like.

In the circumferential direction of the locking element the stop face preferably extends only over a first part of the circumference of the locking element, whilst a second part of the outer circumference of the second section aligns with or extends radially inside a part of the outer circumference of the first section, viewed in the longitudinal direction of the locking element. The locking element should be located in the implement coupling in such a way that if the implement is situated right beside the locking element the implement can be allowed to slide with its outer periphery towards the locking element along the first section and the second section without the stop face being applied against the implement. The stop face may therefore typically be defined by a heel, which only extends along a part of the periphery of the locking element, viewed in the circumferential direction.

According to a preferred embodiment the locking element, in the absence of any contact between the stop face and the implement, is designed to be displaced into a position beyond the position corresponding to its operative position. In the case described above, in which the implement is situated right beside the locking element and its movement cannot be stopped by application of the stop face against the implement, it is thereby possible to register that this is the case, since it can be registered by means of sensors, as will be described later, that the locking element has been displaced past the position corresponding to its operative position.

According to an aspect of the present invention, an implement locking element includes, over a second section adjoining a first section, a second cross-section, which prevents the second section being shot into a hole, the second section comprising a stop face designed to be brought to bear against the implement.

An aspect of the invention furthermore relates to a method of detecting the attainment of a fixing position of a working machine according to the invention, wherein attainment of the bearing position is registered electronically. Registering of the attainment of the bearing position is preferably displayed electronically in a driver's cab of the working machine.

BRIEF DESCRIPTION OF THE DRAWINGS

The present invention will be described in more detail below and, by way of example, with reference to the drawings attached, in which.

DETAILED DESCRIPTION

Figure 1:
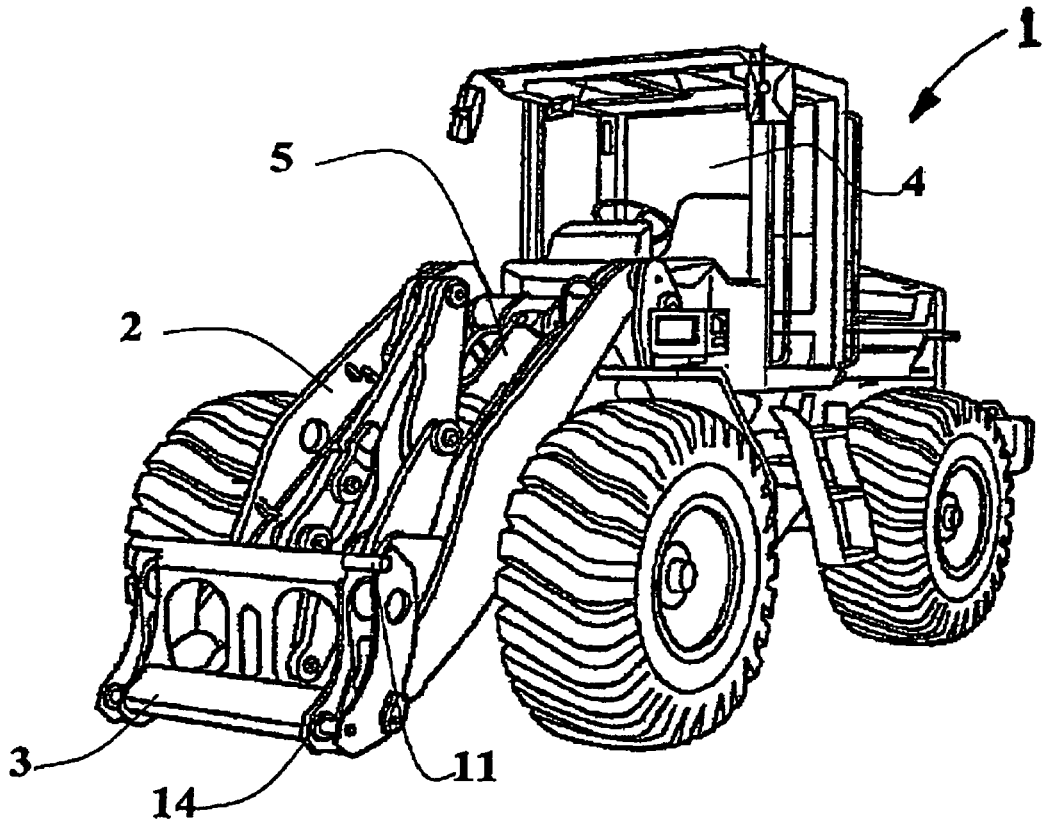
FIG. 1 is a perspective view of a working machine provided with an implement coupling according to the invention.

FIG. 1 shows a working machine 1, in this case a wheeled loader, which is provided with a lift arm 2 and an implement coupling 3 fixed to one end thereof. The working machine 1 comprises an operating station, a driver's cab 4, from which an operator controls the machine 1. The lift arm 2 is preferably hydraulically powered by means of hydraulic cylinders 5 and comprises or forms part of an articulated arm assembly of conventional type.

The implement coupling 3 is preferably articulated and thereby pivotally or at least tiltably coupled to the lift arm 2. The implement coupling 3 is formed from a frame or a body which, viewed from the front, as in FIG. 3, has a substantially rectangular outer periphery and comprises vertical side pieces 6,7, a vertical center piece 8 and an upper and a lower horizontal cross member 9,10. The body of the implement coupling 3 may be integrally cast in one piece, the division into side pieces and cross members being done in order to facilitate the description of its form.

Figure 2:
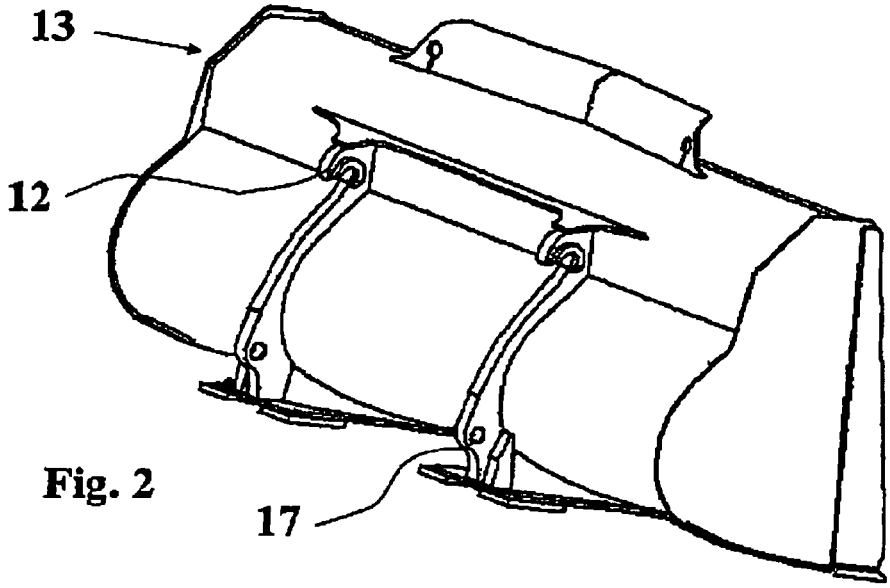
FIG. 2 is a figure showing an implement designed to be coupled to the implement coupling in FIG. 1.

Horizontally extending pins 11 are fastened in the area of each of the upper corners of the frame of the implement coupling 3. The function of these pins 11 is to be gripped from above and to act as supports for hooks 12, which are arranged on an implement 13, as shown in FIG. 2.

Figure 3:
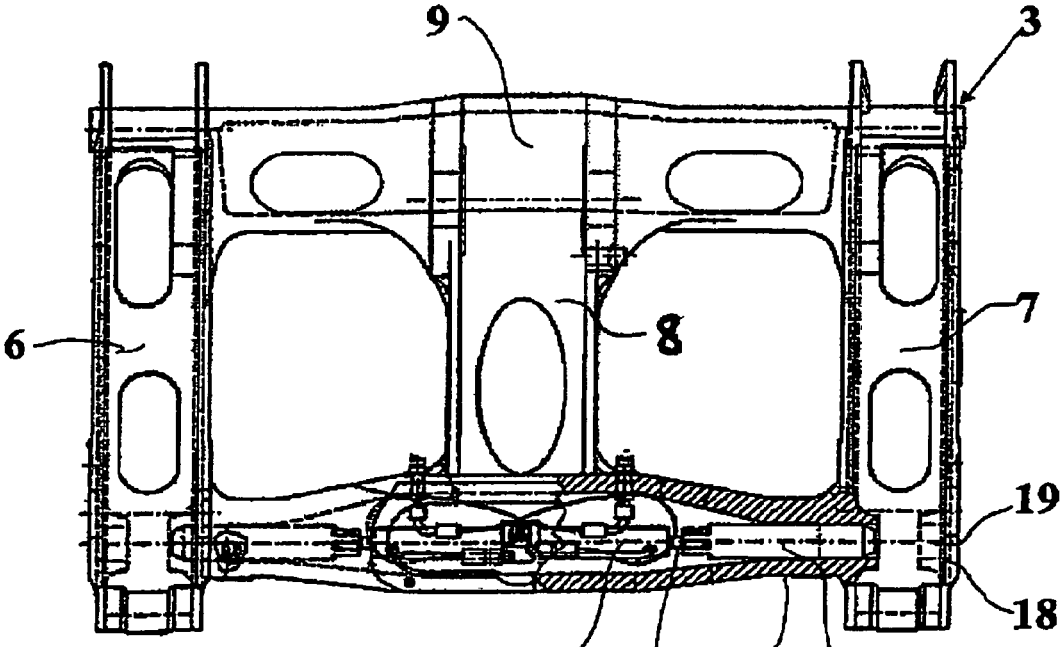
FIG. 3 is a cross-sectional view from the front of an implement coupling according to the invention.

A locking element in the form of a horizontally extending pin 14, displaceable in the horizontal direction and in its longitudinal direction is arranged in the area of each of the opposing lower corners of the implement coupling 3 according to FIG. 1 and FIG. 3. Each pin 14 is coupled to a respective piston 15 in a hydraulic cylinder 16, which is arranged in the lower horizontal cross member 10 (see FIG. 3). Each pin 14 is designed to be displaced from an inoperative position, in which it is sunk into the lower horizontal cross member 10, into an operative position, in which it projects out of said cross member 10 far enough to be able to shoot into or through a hole 17, which is arranged in a lug or the like of the implement 13. In other words, the pins 14 are shot outwards towards opposing holes from the middle of the implement coupling. In the preferred embodiment the pins are hydraulically powered, for example as described above. However, they may also be driven in some other way, for example by means of an electric motor.

Figure 4A:
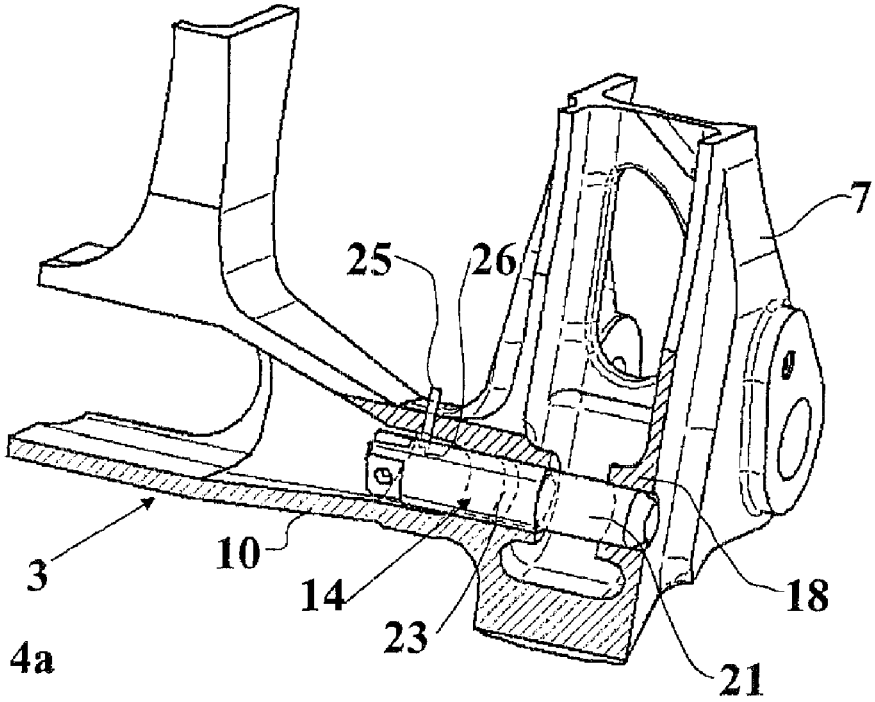
FIGS. 4*a* and 4*b* show an enlarged detail of the implement coupling according to FIG. 3, with and without locking element, FIG. 5 *a-c* show a perspective view, a side view and an end view of a locking element of the implement coupling according to the invention.
Figure 4B:
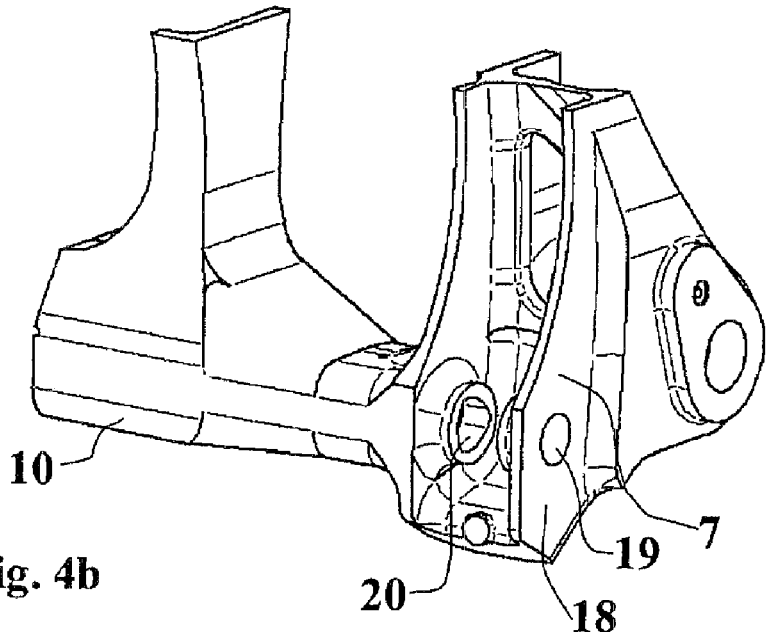

As shown in FIG. 3 and FIGS. 4*a* and 4*b*, the implement coupling 3 preferably, as in this case, comprises a vertical bracket or a vertical wall piece 18, which is arranged beside and at a distance from the end of the lower cross member 10, from which a locking element in the form of a pin 14 can be shot out. The bracket or the wall piece 18 is provided with a hole 19, into which the pin 14 is designed to shoot when it is in its operative position. The pin 14 is supported by the edge of the hole 19 when it is carrying the implement. The wall piece 18 and the end of the cross member 10 define a slot or a gap between them, which is wide and deep enough for a conventional holed lug or the like of the implement 13 to be inserted between them and for the hole 17 in the implement to thereby align with the hole 19 and with a guide, preferably a hole 20, in which the pin is guided in the lower cross member 10. It must be emphasized in this context that the various parts of the frame of the implement coupling are divided up in this way primarily as an aid to understanding the invention, and that it must be appreciated that all the parts described, including said wall piece 18, can be integrally formed in one single piece, for example by casting, and connected together either directly or via other intermediate pieces.

Figure 5A:
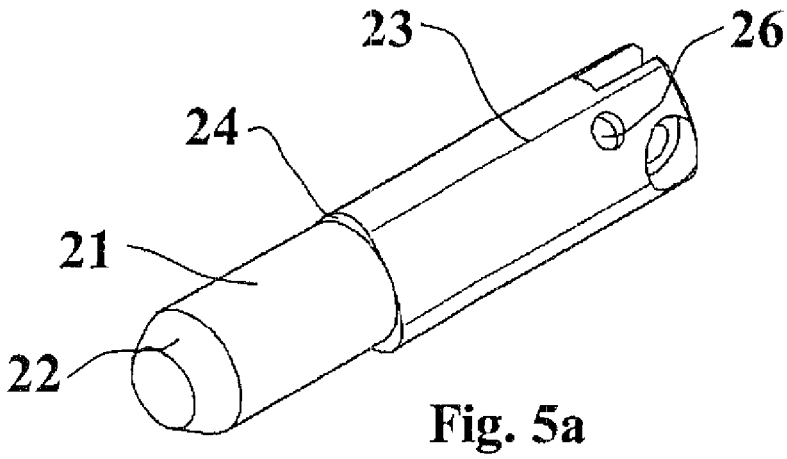
Figure 5B:
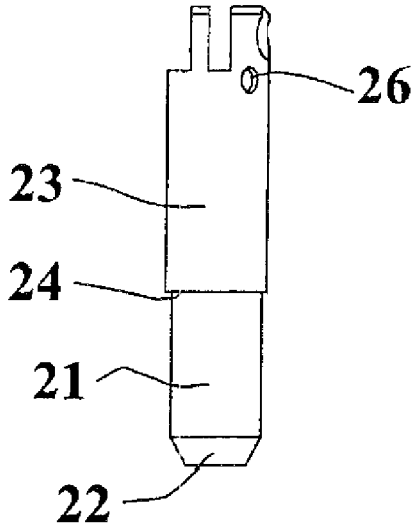
Figure 5C:
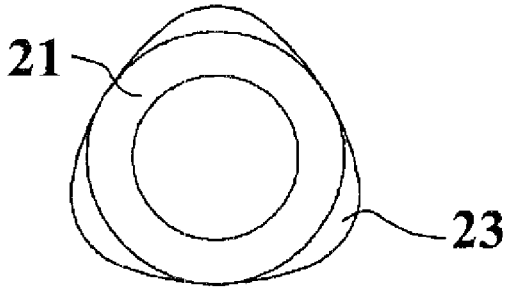
Figure 6A:
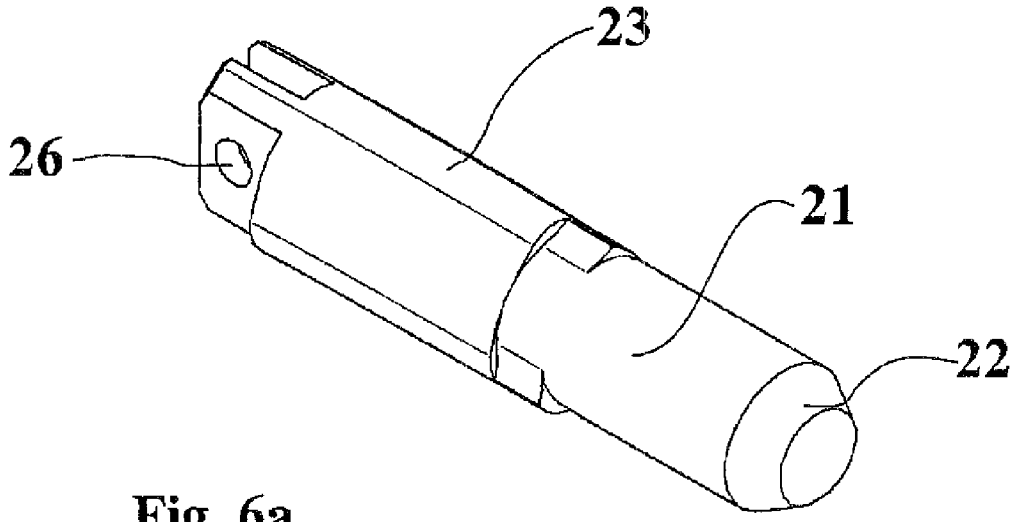
FIGS. 6*a* and 6*b* show perspective views of a locking element according to a second example of an embodiment of the invention.
Figure 6B:
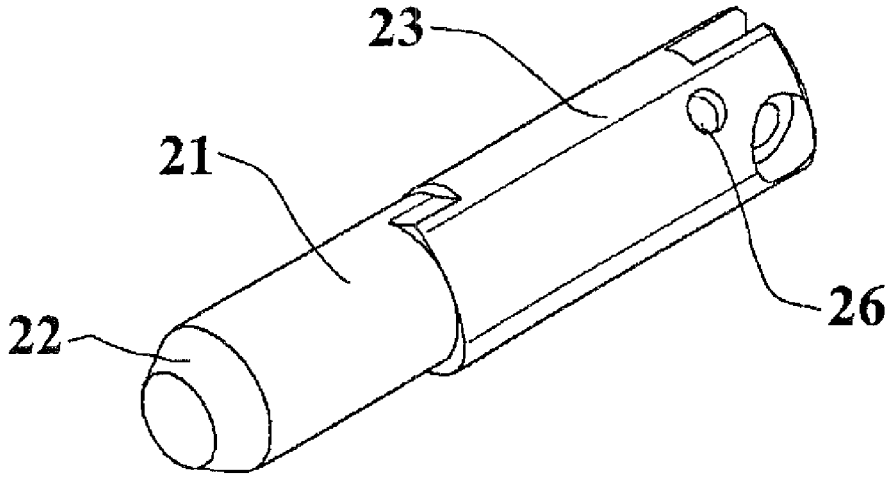
Figure 6C:
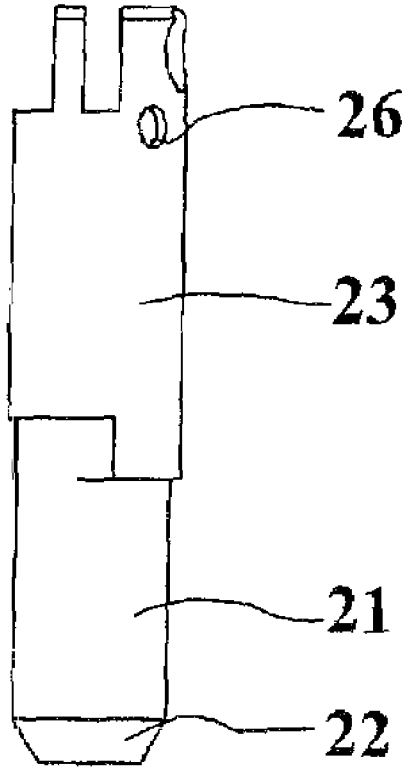
FIGS. 6*c* and 6*d* show a side view and a front view of the locking element according to the second example of an embodiment.
Figure 6D:
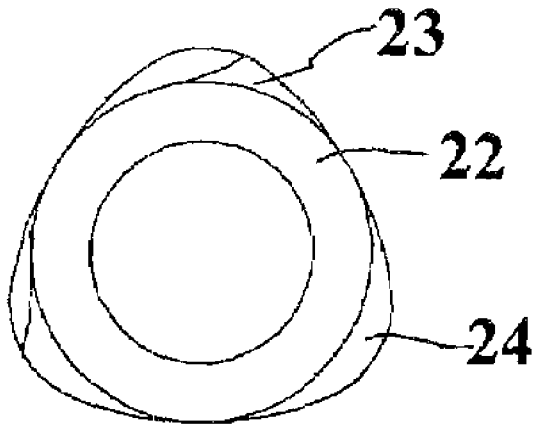

The locking element, the pin 14, as shown in FIG. 5*a*-5*c*, is guided inside the lower cross member 10 of the implement coupling 3 by means of a guide in the form of a hole 20. The pin 14 has a first section 21, which in its operative position is designed to shoot through the hole 17 in the implement 13 and also into the hole 19 in the wall piece 18. The first section 21 extends to the free end of the pin 14, at which a bevel 22 is arranged in order to facilitate introduction of the pin into the hole 17 and the hole 19. The first section 21 preferably has a circular cross-section, as can be seen from FIG. 5*c*.

Immediately adjoining the first section 21, the pin 14 has a second section 23, which around a part of the outer circumference of the pin projects radially outside the first section 21, so that a stop face or heel 24 is formed at the transition between the first section 21 and the second section 23. The stop face 24 is large enough to fulfill is function as a stop heel to prevent introduction of the second section 23 into the hole 17 of given diameter, in which the first section 21 can be shot, once the first section 21 has been introduced into said hole 17.

The implement coupling 3 comprises means 25, 26 of detecting and indicating the position of the pin 14 in its displacement direction, preferably the position when the pin 14 has been displaced into a position corresponding to its operative position. In the preferred embodiment shown, said means 25, 26 comprise an inductive sensor 25 arranged in a recess in the material of the implement coupling, and a recess 26, which is arranged in the pin 14. From the received change in a magnetic flux generated by the sensor 25, the sensor detects when the recess is situated in a certain position, preferably directly opposite the sensor 25.

The sensor 25 may be of a type which transmits a signal when the pin 14 is displaced into a position corresponding to its operative position, or of a type which transmits signals in all other positions. The sensor 25 is suitably operatively connected to a display device, such as a light or display, in a driver's cab of the working machine. Its signal is displayed for an operator who can thereby determine whether the implement coupling is being correctly coupled. Both or all of the pins 14 should be in the correct coupling position in order for a signal indicating the correct coupling position to be displayed. Alternatively, the signal from the sensor indicating the attainment of a correct fixing or coupling position may be used to control a function of the working machine. For example, in response to such a signal the vehicle can be prevented from moving or performing movements with the lift arms, for example by applying brakes or the like. In such cases the preventive function in itself indicates to an operator that the fixing position has not been reached.

The sensor 25 is preferably designed to register an operative position with a certain delay. In other words, it is designed to emit the operative position signal only when such an operative position has been registered by the sensor within a predefined minimum time period. This serves to prevent an operative position being signaled in instances where the locking element 14 completely misses the implement 13 and passes what is by definition the operative position during a short period on its way to its maximum projecting position. However, in order to prevent the measurement being over-sensitive to deviations from the precise "operative position" due, for example, to different widths/thicknesses of the lugs of the implement (13) in question, it is advisable to arrange the sensing and indicating means 25, 26 in such a way that the "operative position" is registered over a predefined displacement interval for the locking element 14. For this purpose, for example, the hole 26 may be given a length in the displacement direction of the locking element 14 which results in such a registration displacement interval. Alternatively, the sensor or a computer unit connected thereto may be programmed so that such an interval is accepted as "operative position".

There are some instances in which the implement 13 ends up right beside the locking element/the pin 14, but is still so close to the latter that a stop face or stop heel running right round the circumference of the pin 14 could strike an edge on the implement when the pin 14 is displaced, thereby causing a false indication of the operative position. In order to avoid this situation, in the circumferential direction of the locking element 14 the stop face 24 only extends over part of the circumference of the locking element 14. In the examples of embodiments shown in FIGS. 5 and 6 this is achieved in that a part of the outer circumference of the second section 23 aligns with a part of the outer circumference of the first section 21, viewed in the longitudinal direction of the locking element 14. The surface thus formed without a stop heel should, when the locking element 14 is located in the implement coupling 3, be directed outwards/forwards from the implement coupling 3 and the machine 1, and should extend in the circumferential direction of the locking element in such a way that it covers the entire angular interval within which the implement, in practice, can come to bear against the locking element 14 from the type of "incorrect" coupling described above. It is therefore important that the locking element 14 be arranged so that it is not capable of rotating in the implement coupling 3. To this end, the guide 20 in the implement coupling 3 may be designed to interlock with the outer periphery of that part of the locking element 14 which is designed to be guided therein. This part of the locking element 14, which can be guided by the guide 20, should therefore have a non-circular cross-section over a part of its length.

In the example of an embodiment according to FIG. 5*a*-5*c* the second section 23 has a triangular cross-section, the corners of the triangle formed by the cross-section projecting outside the circumference of the first section 21 to form three stop faces 24 distributed circumferentially. Between the stop faces 24 the periphery of the first section 21 coincides with the periphery of the second section 23. It would also be feasible, however, for the periphery of the second section 23 in places to lie radially inside the periphery of the first section 21. The second section 23 here moreover extends in the longitudinal direction of the locking element 14 in such a way that it also forms the part of the locking element that is guided in the guide 20. The guide 20 for this purpose defines a channel having a corresponding triangular cross-section.

FIG. 6*a*-6*d* shows an alternative example of an embodiment of the locking element 14 according to the invention.

The only substantial difference between this locking element and that shown in FIG. 5 is that the second section 23 in this case has a larger angular range, greater than 45° preferably greater than 90°, over which the periphery of the second section aligns with or lies radially inside the periphery of the first section 21. This has here been achieved in that, over a length of the second section 23 from its beginning at the first section 21, the periphery of said second section 23 has been machined so that it aligns with the periphery of the first section 21, and therefore does not have the triangular cross-section. The remainder of the second section 23, however, has the same triangular cross-section as that shown in FIG. 5.

It will be appreciated that cross-sectional shapes other than the triangular are perfectly possible without departing from the scope of the invention, but that the triangular shape has been preferred, among other things, for strength reasons.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

It will be appreciated that a number of variants of the invention will be obvious to a person skilled in the art without departing from the scope of the invention or the extent of the protection, as defined in the claims attached, based on the description and the drawings.

What is claimed is:

1. A working machine, comprising a lift arm and an implement coupling fixed to the lift arm and comprising a locking element, the locking element being displaceable between an inoperative position and an operative position in which it is adapted to be received in a hole in an implement in order to lock the implement to the implement coupling, wherein the locking element, over a first section of its length, has a first cross-section sized to permit the first section of the locking element to be received in the hole in the implement, and over a second section, which adjoins the first section, the locking element has a second cross-section sized to prevent the second section from being received further in the hole, the second section comprising a stop face adapted to bear against the implement when the locking element secures the implement to the implement coupling, wherein in the circumferential direction of the locking element the stop face only extends over a part of a circumference of the locking element.

2. The working machine as claimed in claim 1, wherein a part of an outer circumference of the second section aligns with or is disposed radially inward of a part of the outer circumference of the first section.

3. The working machine as claimed in claim 1, wherein the locking element, when there is no contact between the stop face and the implement, is adapted to be displaced into a position beyond a position corresponding to its operative position.

4. The working machine as claimed in claim 1, comprising a sensor arrangement for detecting and indicating when the locking element has been displaced into a position corresponding to its operative position.

5. The working machine as claimed in claim 1, wherein the locking element and the implement coupling have interfering surfaces so that the locking element is non-rotatable relative to the implement coupling.

6. The working machine as claimed in claim 5, wherein the implement coupling comprises a guide in which the locking element is displaceable in its longitudinal direction, and the locking element and the guide have complementary cross-sections which produce a locking of the locking element in the guide so as to prevent rotation of the locking element relative to the guide.

7. The working machine as claimed in claim 6, wherein the locking element has a noncircular cross-section over at least part of its length.

8. The working machine as claimed in claim 6, wherein the locking element has a cross-section that defines a polygon over at least part of its length.

9. The working machine as claimed in claim 1, wherein the implement coupling comprises a first and a second support section, a slot being defined between the first and the second support section for the insertion of a part of the implement in which the hole is provided such that the hole is situated directly opposite the locking element and the locking element is adapted to be received in and locked in position relative to the hole, the first and second support sections being arranged such that a capacity for displacement of the implement in a displacement direction of the locking element is limited.

10. An implement locking element comprising a first section having a first cross-section adapted to allow the first section of the locking element to be received in a hole of given geometry defined by an implement to be locked, and a second section adjoining the first section and having a second cross-section adapted to prevent the second section from being received in the hole, the second section comprising a stop face adapted to bear against the implement, wherein in a circumferential direction of the locking element the stop face extends over at least part of a circumference of the locking element, wherein the locking element has a cross-section that defines a polygon over at least part of its length, and wherein the stop face is defined by a corner of the polygon, the corner projecting radially outside an outer circumference of the first section.

11. The implement locking element as claimed in claim 10, wherein the polygon is a triangle.

12. The implement locking element as claimed in claim 10, wherein the first section has a circular cross-sectional shape.

13. An implement coupling for fixing a working implement to a working machine, comprising an implement locking element as claimed in claim 10.

14. A method of detecting attainment of a fixing position in a working machine as claimed in claim 1, comprising orienting the locking element relative to implement coupling so that the stop face is only adapted to bear against the implement when the first section of the locking element is received in the hole in the implement and in its operative position, and electronically sensing when the locking element has been displaced into a position corresponding to its operative position.

15. The method as claimed in claim 14, comprising indicating displacement of the locking element into the position corresponding to its operative position in a driver's cab of the working machine.

* * * * *